United States Patent [19]

Cavin et al.

[11] Patent Number: 4,516,905

[45] Date of Patent: May 14, 1985

[54] ROLL CLAMP

[75] Inventors: J. N. Cavin, Houston, Tex.; Kenneth A. Frees, St. Peters, Mo.

[73] Assignee: Hoover Universal, Inc., Ann Arbor, Mich.

[21] Appl. No.: 442,354

[22] Filed: Nov. 17, 1982

[51] Int. Cl.[3] ..... B66F 9/18

[52] U.S. Cl. ..... 414/620; 414/911; 414/621; 294/106

[58] Field of Search ..... 414/619, 620, 621, 911; 294/88, 106

[56] References Cited

U.S. PATENT DOCUMENTS

| | | | |
|---|---|---|---|
| 2,815,873 | 12/1957 | Vance | 414/620 |
| 2,870,929 | 1/1959 | Quayle | 414/620 |
| 3,198,568 | 8/1965 | Mindrum | 414/619 X |
| 4,177,000 | 12/1979 | Weinert et al. | 414/620 |
| 4,227,850 | 10/1980 | Farmer et al. | 414/620 |
| 4,435,119 | 3/1984 | House | 414/620 |

*Primary Examiner*—Robert J. Spar
*Assistant Examiner*—Ken Muncy
*Attorney, Agent, or Firm*—Stephenson and Boller

[57] ABSTRACT

A roll clamp for handling of rolls or other loads carried by a lift truck. The clamp includes a rotator having a rear base plate for being mounted upon the lift mast of the truck, permitting it to be raised or lowered to a vertical position. A frame is gimballed to the rotator front plate. Extending forwardly from the clamp assembly is a pair of clamp arms which are swingably disposed, or pivot relative to the frame for closing and opening by movement toward and away from each other. The rotator rotates the frame relative to the mast about a clamp rotation axis. Hydraulic cylinders selectively open and close the arms, which have clamp pads at their distal ends for engaging the load surfaces. The rotator base plate carries a swash ring defining a plane skewed relative to the axis of clamp rotation. The frame includes rollers bearing against the ring to tilt the frame relative to the rotation axis as the clamp rotates, causing the clamp arms to skew relative to the pivot axis as the base is rotated and automatically causing one arm to overextend the other when the clamp arms are in an orientation for horizontal load disposition.

9 Claims, 7 Drawing Figures

ROLL CLAMP

BACKGROUND AND SUMMARY OF THE INVENTION

This invention relates to roll clamps for lift trucks or the like and, mcre particularly, to an improved roll clamp more readily permitting loads to be picked up when horizontal.

Roll clamps as conventionally mounted upon the lift mast of lift trucks are intended to pick up, carry, transport and set down rolls of paper such as used for newsprint and other purposes, as well as drums, tube sections, gas cylinders and various other loads of cylindrical character. In the handling of such loads by means of a roll clamp of this type, the operator may be called upon to pick up the load which is standing on its end, i.e., with its axis of cylindricity vertical, as when paper rolls are transported by truck. After the rolls are transported, they must be set down in either horizontal or vertical orientation. If horizontal, rotation of the clamp is required.

When a cylindrical load is disposed or picked up in horizontal orientation, such as when lying on the floor or ground, it is difficult to engage the load with the clamp pads unless the upper arm overreaches the lower arm. This problem is compounded also with regard to paper rolls which are full size when placed horizontally for being unrolled but are quite small when nearly used up. When a cylinder load is picked up in horizontal orienation, it often must be rotated to vertical position for stacking or transportion such as in a truck trailer, freight car, warehouse, etc. The limited space available in this situation requires delicate maneuvering of the lift truck. Although one arm of the clamp could be designed longer than the other so as to provide overreaching that arm when the load is horizontal, as in Bittner U.S. Pat. No. 4,209,280 and Farmer et al U.S. Pat. No. 4,160,260, this would present a difficulty when the rolls must be handled vertically in confined quarters as required during storage or transportation. In those situations, it is preferable to have the arms of equal length, and not be skewed to either side in front of the truck.

To cause overreaching of one arm relative to the other, roll clamps have also been designed by offset pivoting of the arms offset from the axis of rotation of the roll clamp assembly and by utilizing auxiliary hydraulic cylinders to shift the arms offcenter about the pivot axis. Typical of such roll clamp configuration is that disclosed in Farmer et al U.S. Pat. No. 4,227,850. However, when the hydraulic cylinder is used to shift one of the arms forward relative to the other, the center of gravity of the load is necessarily displaced forwardly from the lift truck. Since rolls may weigh up to several thousand pounds, the forward relocation of gravity produces a substantial moment arm which imbalances the lift truck and consequently results in a derating of its load capacity.

A further disadvantage of this overreach design is the need for as well as the cost and complexity of the hydraulic cylinder, which must be of considerable size appropriate to lifting such heavy loads. Because of the need for high power for the cylinder and the need for it to extend over a substantial distance, compound, double-acting cylinders have had to be used and these are complex and expensive to build and assemble. Typical of roll clamp designs employing cylinders for this purpose also are disclosed in Weinert et al U.S. Pat. No. 4,177,000.

Lift trucks typically provide tilting of the lift mast several degrees forwardly and rearwardly but this is inadequate for providing the desired unequal extension of the clamp arm ends necessary for picking up small rolls in a horizontal orientation such as when most of the paper on a roll has been unrolled (as in printing) and the used up roll must be replaced by a fresh roll. See, for example, Quayle U.S. Pat. No. 2,870,929. That patent proposed the use of wedge-shaped hangers for mounting the clamp of the lift truck mast to support the clamp from a front plate of the lift truck, thereby increasing the angle of the clamp arms relative to horizontal when the lift truck mast is tipped forward. However, this also undesirably displaces the center of gravity forward of the truck, resulting in a derating of its capacity.

Accordingly, it is an object of the present invention to provide a roll clamp for lift trucks for lifting rolls or other cylindrical loads which permits the clamp arms to be of identical length when the load is to be clamped with its axis vertical but which automatically provides for skewing of the arms to provide overreaching of the lower arm by the upper arm when the clamp arms are rotated for horizontal disposition of the axis of the load, and which also then automatically returns the clamp arms to a symmetrical position, being no longer skewed, when the clamp arms are once more rotated for vertical disposition of the load axis.

It is another object of the invention to provide such a roll clamp which does not cause forward dislocation of the center of gravity of the load when the clamp arms are rotated for horizontal load disposition and which does not necessitate derating of the lift truck capacity to provide overreaching of the upper arm for horizontal disposition of the load.

An object of the invention is also to provide such a roll clamp for which automatic re-orienting and skewing of the arms to a configuration with one arm overreaching the other occurs with smooth, low friction, efficient operation, requiring relatively little rotation power even when handling heavy loads such as paper rolls weighing thousands of pounds.

It is an object of the invention to provide such a roll clamp which can be easily and readily mounted to existing types of lift trucks without requiring redesign of same, and which is itself of simple, strong and economical construction.

Briefly, a roll clamp of the invention for being carried by a lift truck comprises a rotator including a rear base plate for being mounted upon the lift mast of the truck, permitting it to be raised or lowered to a vertical position. A frame is gimballed to a front plate of the rotator and from this frame extends forwardly a clamp assembly including a pair of clamp arms which are swingably disposed, or pivot relative to the frame for closing and opening by movement toward and away from each other. The rotator is provided for rotating the frame relative to the mast about a clamp rotation axis extending forwardly from the mast. Hydraulic cylinders serve as power means for selectively opening and closing the arms, which have clamp pads at their distal ends for engaging the surfaces of the load. The rear base plate of the rotator carries a swash ring defining a plane skewed relative to the axis of clamp rotation. The frame includes rollers which bear against the ring to cause tilting of the frame relative to the rotation axis as the clamp rotates. In this way, the clamp arms skew relative to the pivot axis as the base is rotated, automatically causing one arm to overextend the other when the clamp arms are in an orientation for horizontal load disposition.

Other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
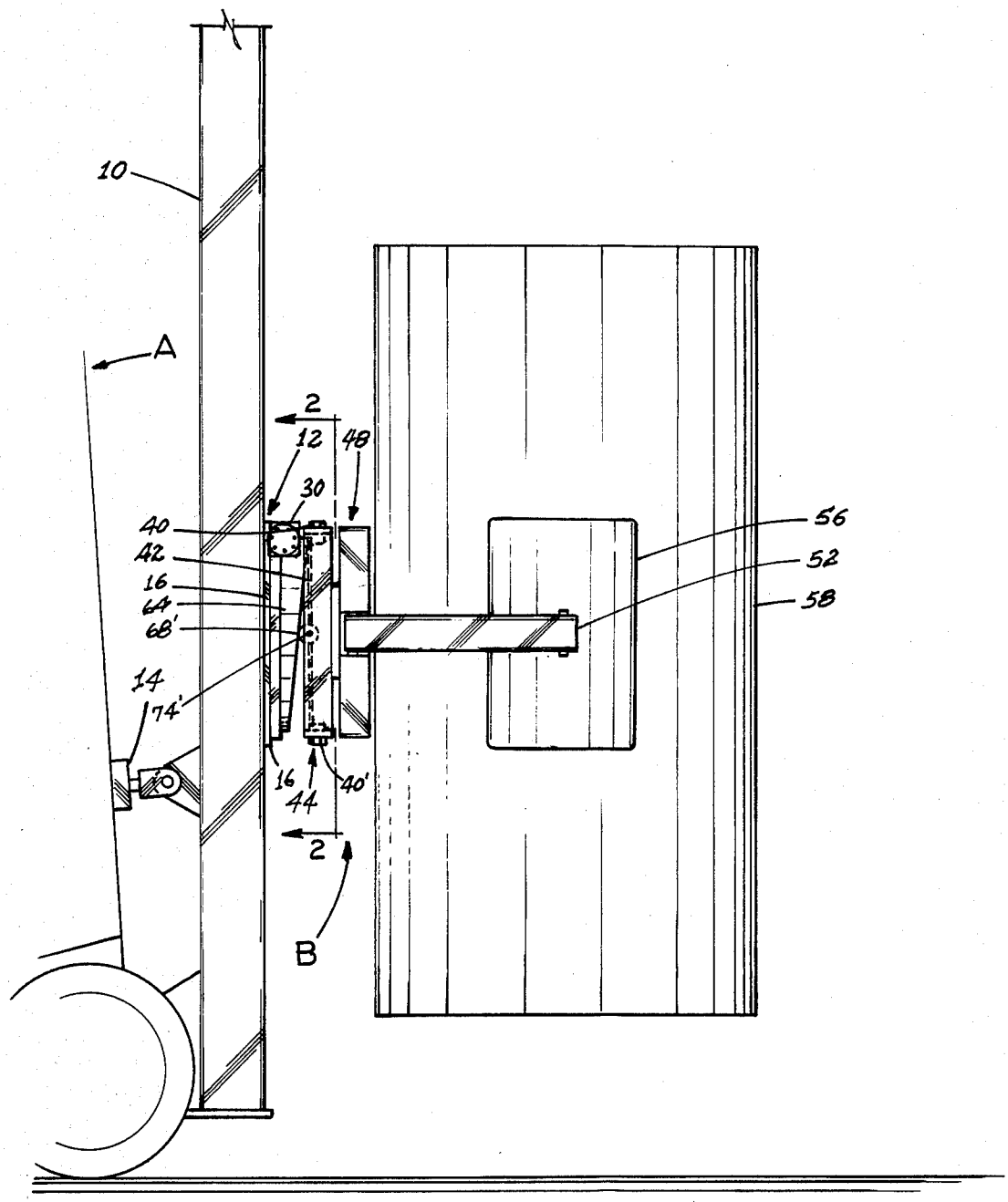
FIG. 1 is a side elevation view of portions of a lift truck having a lift mast and a roll clamp carried by the lift mast, the roll clamp embodying the present invention.
Figure 3:
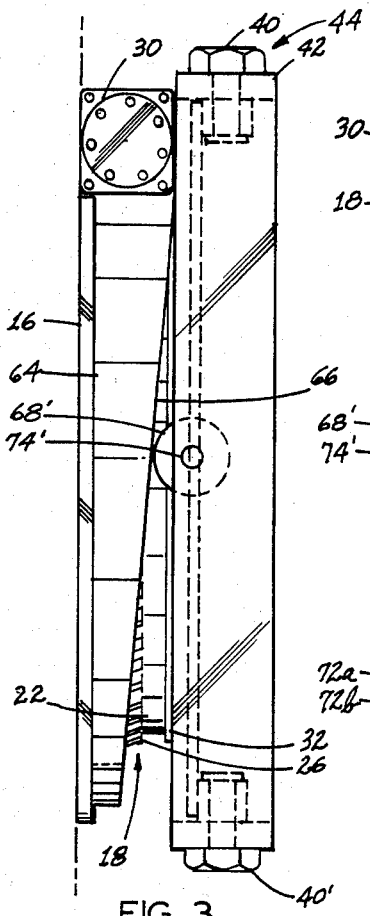
FIG. 3 is a side elevation view of the apparatus of FIG. 2.
Figure 2:
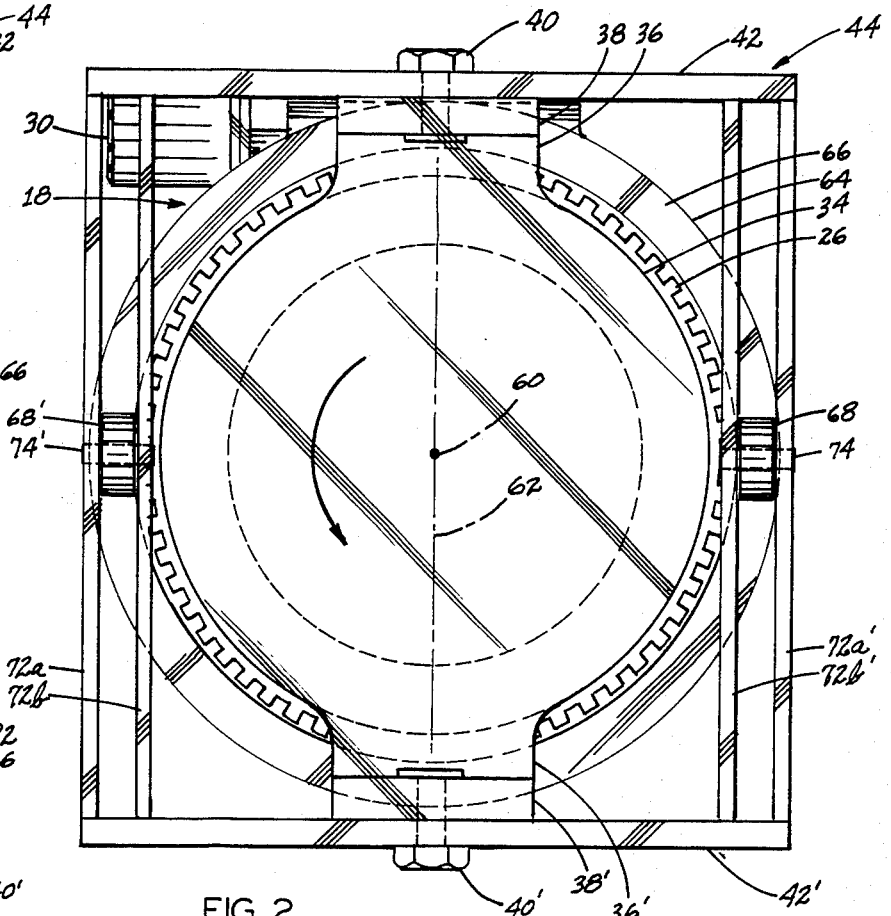
FIG. 2 is an enlarged front elevation view of portions of the roll clamp, as taken along line 2—2 of FIG. 1.
Figure 7:
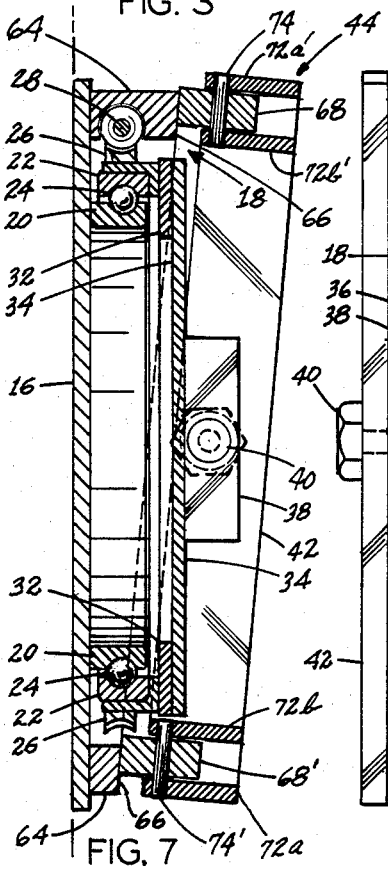
FIG. 7 is a vertical cross section taken along line 7—7 of FIG. 6.
Figure 6:
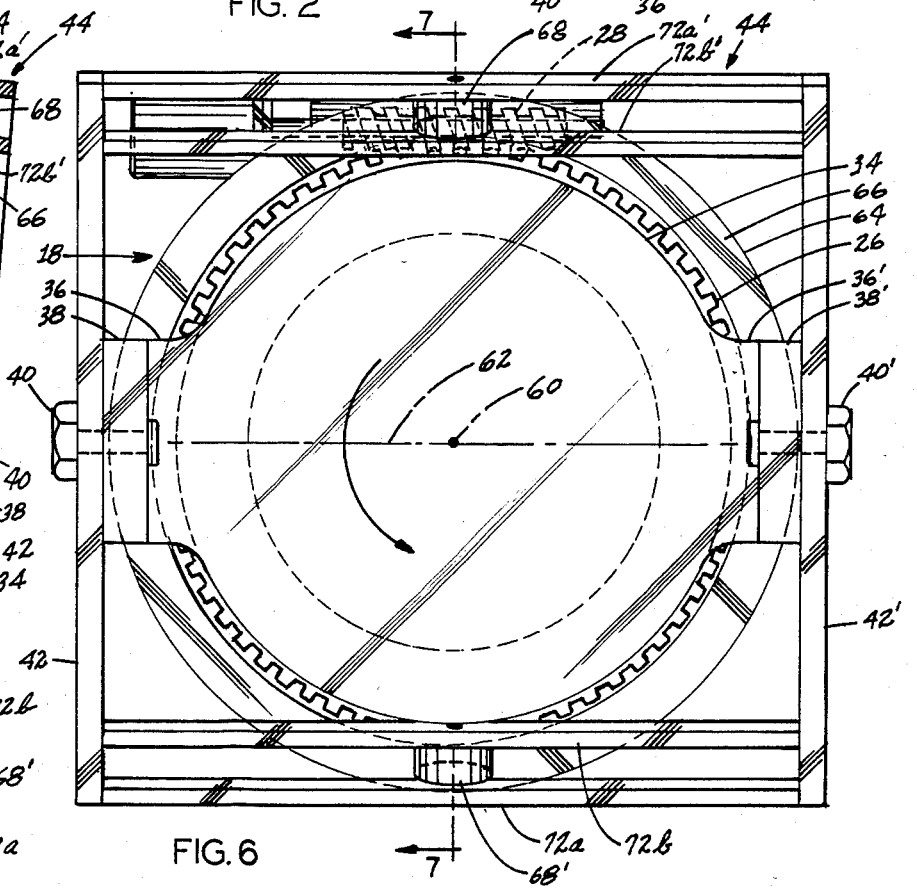
FIG. 6 is a front elevation view of portions of the roll clamp apparatus, as taken along line 6—6 of FIG. 5.

Referring now by reference characters to the drawings and, more particularly to FIG. 1, designated generally at A is a lift truck having usual lift mast 10 having a carriage 12 which can be raised or lowered by the operator to a selected height. Further, mast 10 can be tipped forward or backward over a several degree range of movement by a hydraulic cylinder or the like, as at 14. Mounted upon carriage 12 is a roll clamp of the invention, as designated generally B.

Roll clamp B is intended for picking up and depositing large paper rolls and other large cylindrical loads of the type weighing several thousand pounds, or similar cylindrical objects of various diameters. In this regard, such rolls may weigh thousands of pounds and may vary greatly in diameter. Such loads are intended to be both picked up and deposited with the axis of cylindricity either vertical, as when rolls are delivered by a commercial vehicle, or horizontal, as when such rolls are dispositioned for being placed on a printing press or have been nearly used up and are to be removed from the press. The new roll clamp of this invention provides automatic skewing of the clamp arms as the roll clamp is rotated from the vertical disposition of the load axis to horizontal disposition of the axis, causing one arm to automatically overextend the over in the latter position but without shifting the center of gravity of the roll clamp forward such as would otherwise tend to cause derating of the roll clamp and reduce its capability for lifting heavy loads. Such overextension allows a roll or other cylindrical load to more readily be picked up when it is lying horizontally on a surface. However, as the clamp is again rotated for vertical disposition of the roll or load, the arms automatically return to an orientation of equal extension, symmetric with respect to both the longitudinal axis of the lift truck, and the axis of clamp rotation, as is desirable.

More specifically, roll clamp B has a back plate or base 16 mounted upon carriage 12. Referring to FIGS. 2–7, there is carried upon the front surface of back plate 16 a conventional rotator, generally 18, having an inner race 20 of annular configuration, upon which is journalled an outer race 22, there being ball bearings 24 between the races. The outer race is provided with teeth 26 around its periphery with which is meshed a worm gear 28 driven by a hydraulic motor 30 in either direction under control of the lift truck operator. Mounted by a spacer 32 to outer race 22 is a front plate 34 of the rotator. The front plate serves as an attachment structure for attachment of the clamp proper.

Plate 34 has at opposite sides a pair of ears 36, 36' having respective forwardly extending brackets 38, 38' through which corresponding pivot bolts 40, 40' extend for pivotal securement of opposite sides 42, 42' of a rectangular frame designated generally 44 which actually carries the clamp proper which is designated generally 46.

Clamp 46 includes a clamp arm mounting frame 48 connected by an extension 50 otherwise to frame 44. Swingably disposed by pivots 51, 51' at opposite sides of frame 48 are a conventional pair of clamp arms 52, 52' moving under control of double acting hydraulic cylinders 54, 54'. It is not required that these cylinders be of the complex compound type.

Hingedly connected at the distal ends of arms 52, 52' are respective clamp pads 56, 56' configured for closely conformed gripping of the peripheral surfaces of a roll or other large cylindrical load, as for example, at 58. As will be apparent, cylinders 54, 54' together act to force arms 52, 52' toward and away from each other for gripping engagement of roll 58. Also, because of their hinged securement, pads 56, 56' may also grip even a very small diameter roll, as at 58' in FIGS. 4 and 5. Various conventional hydraulic connectors are not shown to simplify the drawings.

Figure 4:
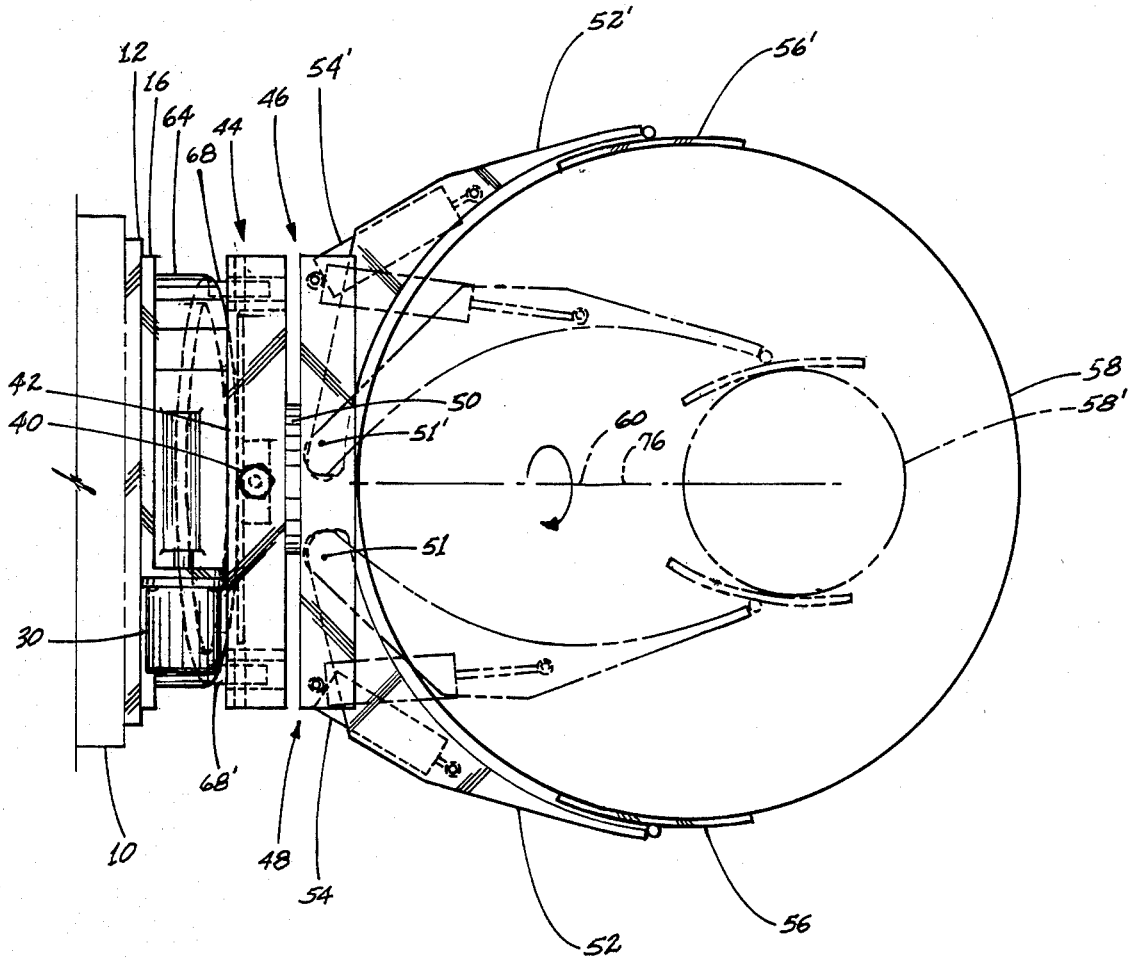
FIG. 4 is a top plan view of the roll clamp, depicting various orientations of the clamp arms for loads of different sizes with the load being in a vertical disposition.
Figure 5:
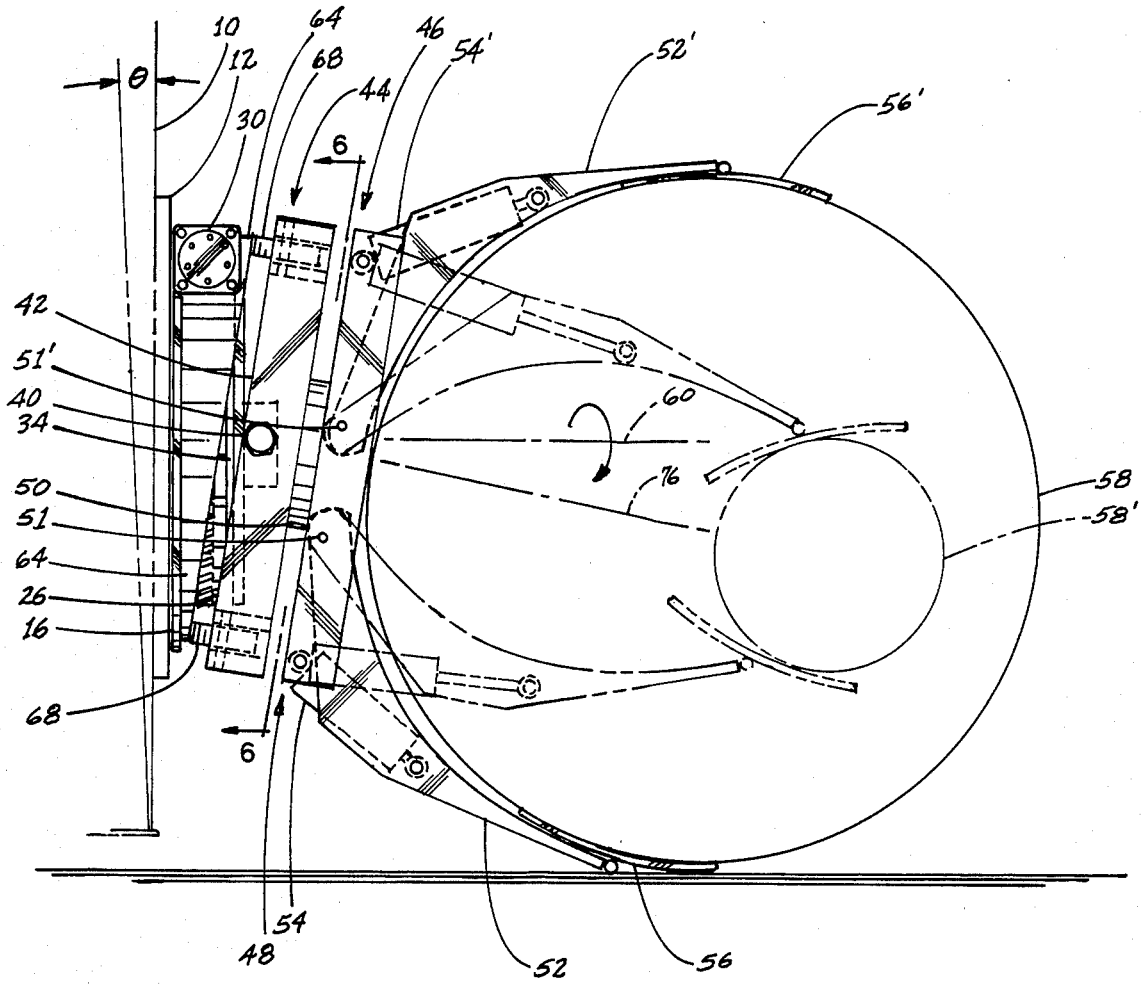
FIG. 5 is a side elevation view of the clamp with the clamp arms re-oriented for horizontal disposition of the load.

Generally, rotator 18 operates to rotate front plate 34, and thus also clamp proper 46, over at least a sector of 90°, permitting clamp arms 52, 52' to be correspondingly rotated from an orientation shown in FIG. 4, wherein the axis of cylindricity of roll 58 is vertical to a position as shown in FIG. 5 wherein the axis is horizontal.

In accordance with the invention, means interengages the base or back plate 16 and frame 44 for causing frame 44 to rotate about an axis of clamp shifting which extends through pivot bolts 40, 40' and on which axis the frame 44 is free to pivot or move angularly relative to base plate 16. This axis of clamping shifting is perpendicular to the axis of clamp rotation resulting from rotational operation of rotator 18. Such axis of clamp rotation, as shown in FIGS. 4 and 5, is designated 60. It is depicted also in FIG. 6 wherein the axis of clamp shifting, designated 62, is seen to be perpendicular therewith.

More specifically, the means for causing the frame 44 to rotate about axis 62 as front plate 34 of the rotator turns is constituted by an annular swash collar 64 having an inclined outer peripheral surface 66 which defines a plane which is inclined relative to base plate by an angle which according to the embodiment illustrated is approximately 5°, thereby providing a normal to the plane which is inclined downwardly and then crosses the axis 60 of clamp rotation at a corresponding angle of approximately 5°. A greater angle may, of course, be utilized for special versions of the new roll clamp.

The invention contemplates the provision of a follower means for bearing against this outer peripheral surface 66 of collar 64. This means comprises a pair of rollers 68, 68' carried by the sides of frame 44 which extend between sides 42, 42' thereof. For this purpose, the sides of frame 44 which carry rollers 68, 68' are each comprised of two elongated frame members, as at *72a*, *72b* and *72a'*, *72b'*. The rollers are held captive between the respective pairs of frame members by suitable pins 74, 74'. Therefore, it will be seen that the rollers roll along the outer surface 66 of the collar as the frame is turned by rotation of front plate 34, causing the frame to rotate about axis 62 and to cause the clamp to shift downwardly, as appreciated best in FIG. 5, wherein the clamp is seen to include an axis of symmetry 76. This axis may be inclined further downwardly by the forward tilting of mast 10 under control of the lift truck operator, as shown by the angle $\theta$ in FIG. 5.

Thus, as rotator 18 operates, clamp arms 52, 52' rotate from the position shown in FIG. 4 to that shown in FIG. 5. In the latter position, the upper arm 52' overreaches the lower arm 52 substantially to permit the lower clamp pad 56 to reach under a roll, such as that illustrated at 58 or 58', regardless of its size and to permit the opposite upper clamp pad 56' to oppose the lower clamp pad effectively and, thus, to permit the operator to pick up a horizontally disposed roll. This provides extraordinary utility of the lift truck when equipped with the new roll clamp. However, because the upper arm 52' is not required to be additionally extended, it will be seen that the center of gravity of the load, such as roll 58, remains the same distance from the clamp arm pivoting frame 48 as it would when the roll is dispositioned for vertical handling. This means that the lift truck does not need to be derated when rolls are handled in horizontal disposition, as has been required with roll clamp handling lift trucks of the prior art.

The new arrangement also makes it possible for the clamp arms to automatically shift, producing skewing of axis 76 as the clamp arms turn to the position for horizontal disposition of the roll or other load without separate operator manipulation of the controls. Similarly also, the skewing of the clamp arms is automatically corrected as the clamp arms return to the position (as in FIG. 4) with the axis of the load in a vertical orientation and wherein it is seen that the axis of symmetry of the clamp is coincident with the axis of clamp rotation 60 and so that the arms are disposed at opposite sides of the roll clamp assembly by an equal distance as is desirable for the handling of rolls and similar large cylindrical loads in closed quarters. In this regard, the lift truck can approach opposite sides of a tractor trailer, for example, when unloading rolls therefrom with equal ease and the operation of the lift truck is not thereby disadvantaged by the otherwise asymmetrical placement of clamp arms as has been utilized heretofore in the prior art.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A roll clamp for being carried by the lift mast of a lift truck or like vehicle for picking up and transporting rolls or like cylindrical objects, said clamp including a pair of clamp arms swingably disposed relative to one another for closing and opening by movement toward and away from each other, means for closing and opening of said clamp arms, clamp pads at the distal ends of said arms for contacting the surfaces of such roll or like cylindrical object, and a base for being mounted upon said lift mast for the raising or lowering of said arms to a desired vertical position by said lift mast, a rotator providing rotation of said arms relative to said mast about an axis of clamp rotation extending forwardly from said mast, and characterized by an attachment structure carried by said rotator for being rotated by said rotator about said axis of clamp rotation, a frame pivotally secured to said attachment structure for permitting angular movement of said frame relative to said base about an axis of clamp shifting, and means interengaging said base and frame for causing said frame to rotate about said axis of clamp shifting as said attachment structure is rotated by said rotator about said axis of clamp rotation, whereby said clamp arms are automatically shifted during rotation of said clamp, said means interengaging said base and frame comprising a structural projection carried by said base and defining a surface inclined relative to said base, and follower means engaged with said inclined surface for causing said frame to be oriented relative to said surface as said attachment structure is rotated about said axis of clamp rotation.

2. A roll clamp according to claim 1 and further characterized by said structural projection comprising an annular swash collar concentric to said axis of clamp rotation, said collar having an inclined peripheral surface, said follower means bearing against said peripheral surface.

3. A roll clamp according to claim 2 and further characterized by said peripheral surface defining a plane inclined relative to said base, said follower means comprising rollers carried by said frame and engaging said peripheral surface.

4. A roll clamp according to claim 3 and further characterized by said securement structure comprising a front plate carried by said rotator and having brackets at opposite sides of said axis of clamp rotation, said frame being rectangular and having a first pair of opposite sides connected respectively by pivots to said brackets, and said frame including a second pair of opposite sides carrying respective ones of said rollers, whereby said axis of clamp shifting extends through said pivots.

5. A roll clamp according to claim 4 and further characterized by said axis of clamp shifting being perpendicular to said axis of clamp rotation.

6. A roll clamp according to claim 3 and further characterized by said plane being inclined downwardly to provide a normal to said plane which crosses said axis of clamp rotation at an acute angle.

7. A roll clamp according to claim 6 and further characterized by said acute angle being approximately 5°.

8. A roll clamp according to claim 4 and further characterized by said rotator having a rotatable member having teeth around its periphery, a worm gear for meshing with said teeth and means for driving said worm gear, said collar being concentric with respect to and surrounding said rotatable member.

9. A roll clamp according to claim 8 and further characterized by said frame having spaced pairs of frame members at the opposite sides carrying said rollers, there being a roller carried between said spaced frame members for rotatable engagement with said collar.

* * * * *